United States Patent [19]

Whitaker, Jr.

[11] Patent Number: 5,062,528

[45] Date of Patent: Nov. 5, 1991

[54] HEATED GOLF BAG APPARATUS

[76] Inventor: Bobby V. Whitaker, Jr., 531 Hartfield St., Jackson, Miss. 39216

[21] Appl. No.: 612,546

[22] Filed: Nov. 13, 1990

[51] Int. Cl.[5] ..... A63B 55/00; F24S 7/10; H05B 3/06

[52] U.S. Cl. ..... 206/315.3; 206/315.5; 206/315.6; 219/521; 219/386

[58] Field of Search ..... 206/315.3, 315.5, 315.6, 206/315.9; 219/521, 386, 400

[56] References Cited

U.S. PATENT DOCUMENTS

| | | | |
|---|---|---|---|
| 3,683,155 | 8/1972 | Loofbourow | 219/439 X |
| 3,707,279 | 12/1972 | Kaiser | 206/315.6 X |
| 4,049,949 | 9/1977 | Fitzsimons | 206/315.9 |
| 4,155,002 | 5/1979 | Cohen | 219/386 X |
| 4,420,681 | 12/1983 | Arnold | 206/315.9 |
| 4,545,362 | 10/1985 | Hendricks | 206/315.9 |

*Primary Examiner*—William I. Price
*Attorney, Agent, or Firm*—Leon Gilden

[57] ABSTRACT

A golf bag is provided to include a helically wound resistance heating element directed through the interior of the golf bag mounted within a liner to position the coil, with a rechargeable battery pack mounted within a bottom compartment of the golf bag. Heated pouches are provided exteriorly of the golf bag for heating of various golfing equipment utilized, as well as a plurality of hand compartments positioned for receiving a golfer's hands during transport of the golf bag. A modified golf bag includes a container of gel to contain and disperse heat utilized in conjunction with the organization.

7 Claims, 3 Drawing Sheets

HEATED GOLF BAG APPARATUS

BACKGROUND OF THE INVENTION

1. Field of the Invention

The field of invention relates to golf bag apparatus, and more particularly pertains to a new and improved heated golf bag apparatus wherein the same provides for heating of golfing equipment to include the golf clubs to maintain the equipment's flexibility during use and a golf game to maintain the equipment's performance.

2. Description of the Prior Art

Various golf clubs have been utilized in the prior art, as well as golfing equipment, but the prior art has heretofore failed to provide a golf bag organization to maintain the golf clubs and equipment in a heated manner as set forth by the instant invention. Examples of prior art include U.S. Pat. No. 4,420,681 to Arnold wherein a golf ball container is arranged for mounting an overlying electric golf cart to direct heat into the golf balls for their use in a game.

U.S. Pat. No. 4,340,102 to Isabel sets forth a golf club bag arranged for containing golf clubs in a conventional manner.

U.S. Pat. No. 4,042,918 to Klitzman sets forth a golf club apparatus wherein an alarm is arranged in association with a golf bag to indicated removal of a golf club therefrom.

U.S. Pat. No. 4,545,362 to Hendricks sets forth a golf ball heater provided within a housing to maintain golf balls at a desired temperature.

U.S. Pat. No. 3,683,155 to Loofbourow sets forth a further example of a golf ball heater to contain a plurality of golf balls and maintain the golf balls in an elevated temperature.

As such, it may be appreciated that there continues to be a need for a new and improved heated golf bag apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of golf bag apparatus now present in the prior art, the present invention provides a heat golf bag apparatus wherein the same is arranged for maintaining golf clubs and associated equipment at an elevated temperature for use in a golf game. As such, the general purpose of the present invention, which will be described subsequently in greater detail, is to provide a new and improved heated golf bag apparatus which has all the advantages of the prior art golf bag apparatus and none of the disadvantages.

To attain this, the present invention provides a golf bag to include a helically wound resistance heating element directed through the interior of the rechargeable battery pack mounted within a bottom compartment of the golf bag. Heated pouches are provided exteriorly of the golf bag for heating of various golfing equipment utilized, as well as a plurality of hand compartments positioned for receiving a golfer's hands during transport of the golf bag. A modified golf bag includes a container of gel to contain and disperse heat utilized in conjunction with the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved heated golf bag apparatus which has all the advantages of the prior art golf bag apparatus and none of the disadvantages.

It is another object of the present invention to provide a new and improved heated golf bag apparatus which may be easily and efficiently manufactured and marketed.

It is a further object of the present invention to provide a new and improved heated golf bag apparatus which is of a durable and reliable construction.

An even further object of the present invention is to provide a new and improved heated golf bag apparatus which is susceptible of a low cost of manufacture with regard to both materials and labor, and which accordingly is then susceptible of low prices of sale to the consuming public, thereby making such heated golf bag apparatus economically available to the buying public.

Still yet another object of the present invention is to provide a new and improved heated golf bag apparatus which provides in the apparatuses and methods of the prior art some of the advantages thereof, while simultaneously overcoming some of the disadvantages normally associated therewith.

Still another object of the present invention is to provide a new and improved heated golf bag apparatus wherein the same maintains golf clubs and associated equipment at an elevated temperature for use during a golf game to maintain efficiency and effectiveness of the equipment for use at desired temperatures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
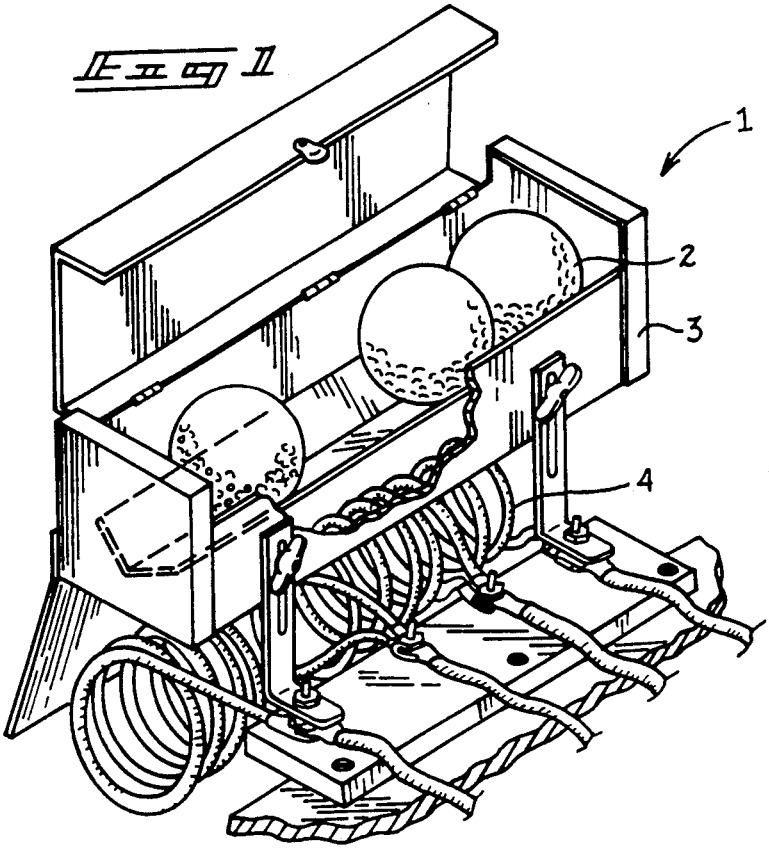
FIG. 1 is an isometric illustration of a prior art golf ball heating apparatus.
Figure 3:
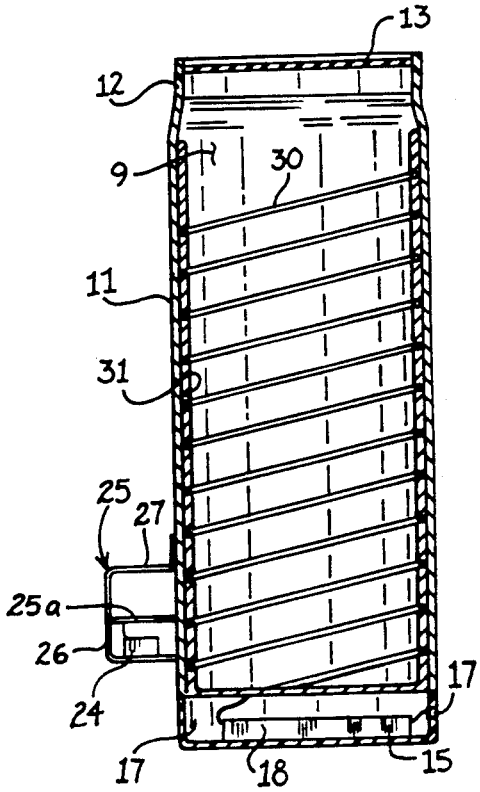
PRIOR ART Fig 3
FIG. 3 is an orthographic view, taken along the lines 3—3 of FIG. 2 in the direction indicated by the arrows.
Figure 2:
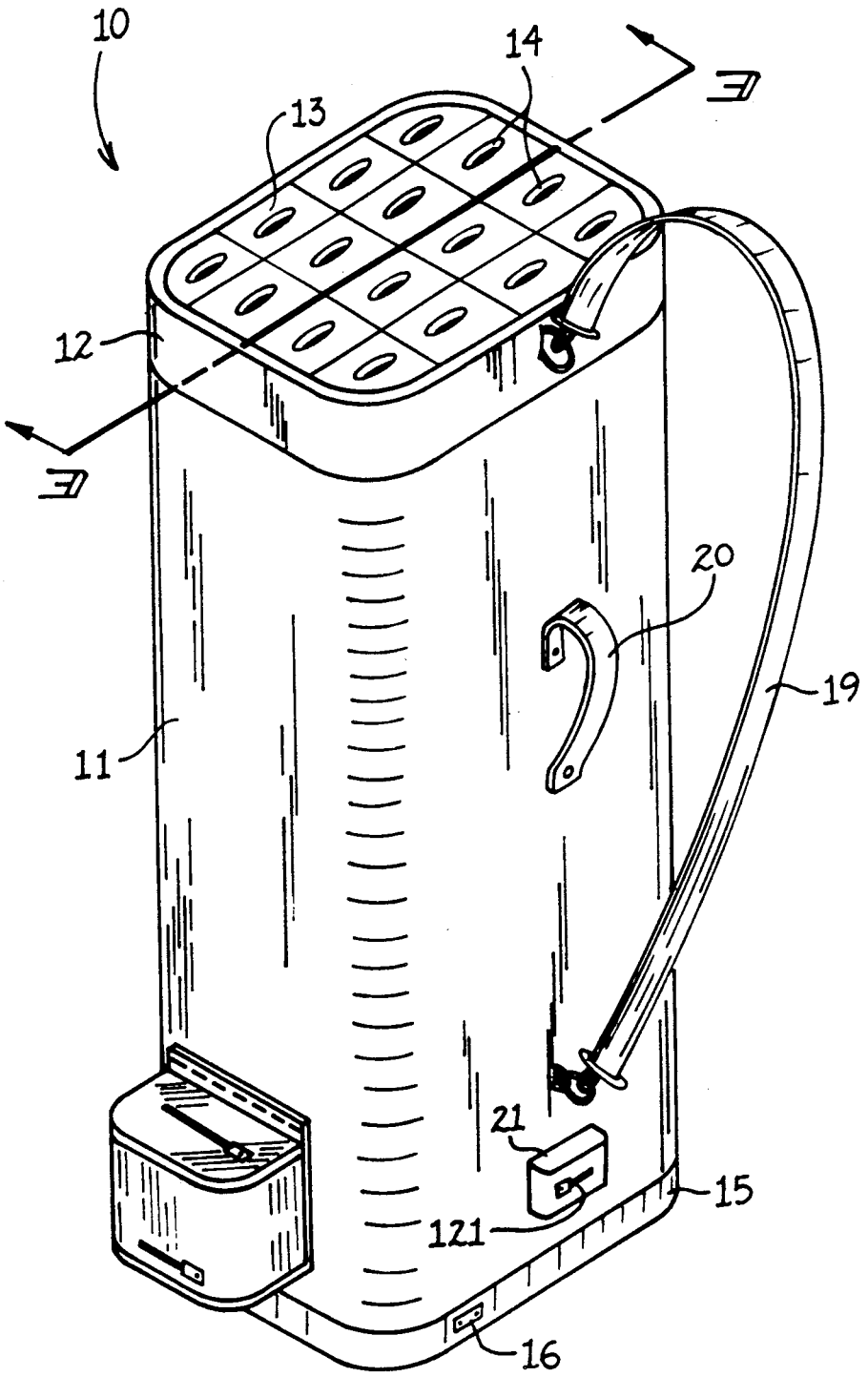
FIG. 2 is an isometric illustration of the instant invention.
Figure 4:
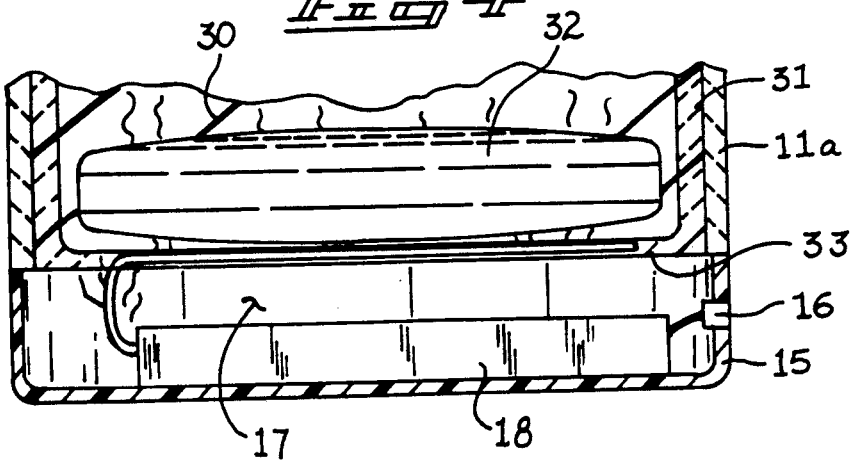
FIG. 4 is an orthographic cross-sectional illustration of a modified golf bag utilized by the instant invention.
Figure 5:
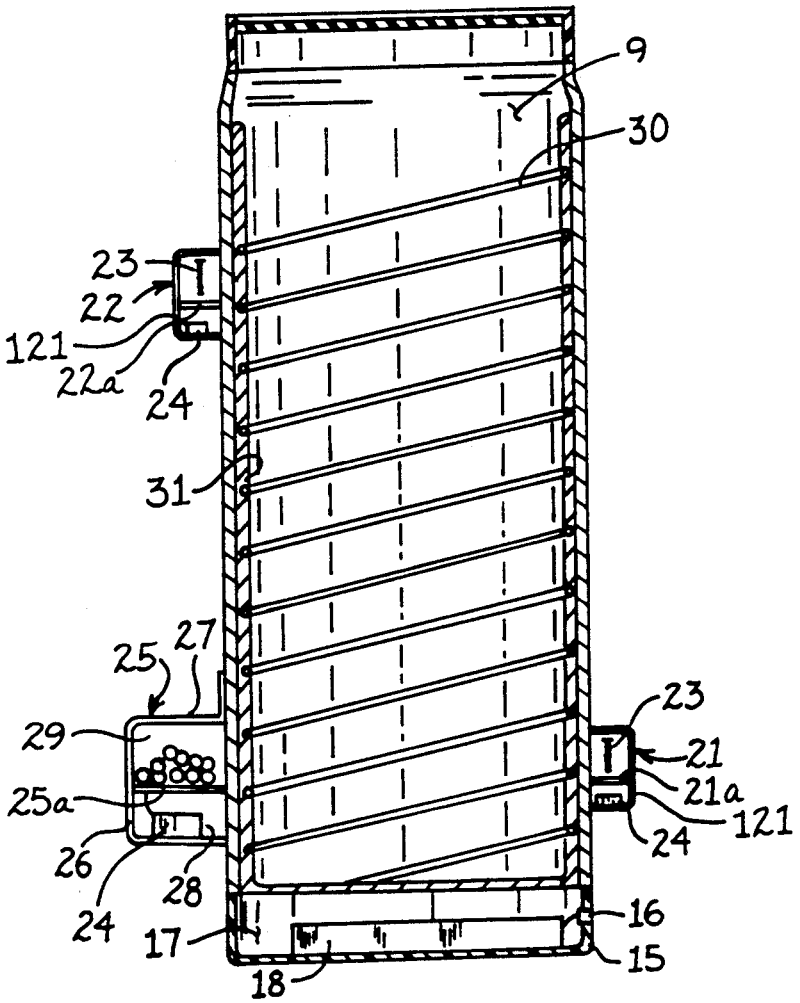
FIG. 5 is an orthographic cross-sectional illustration of the instant invention.

With reference now to the drawings, and in particular to FIGS. 1 to 5 thereof, a new and improved heated golf bag apparatus embodying the principles and concepts of the present invention and generally designated by the reference numeral 10 will be described.

FIG. 1 illustrates a prior art organization, wherein a heated golf ball structure 1 utilizes a container 3 to contain a plurality of golf balls 2 therewithin utilizing a heating coil 4 to direct heat to the overlying golf balls 2, in a manner as set forth in U.S. Pat. No. 4,420,681.

More specifically, the heated golf bag apparatus 10 of the instant invention essentially comprises an elongate, longitudinally aligned bag 11, including an upper bag band 12 mounting an elastomeric web 13 orthogonally to the longitudinally aligned bag 11, with the web 13 including a matrix of slits 14 therethrough. The slits 14 accommodate a golf club handle therethrough, in a manner to sealingly enclose the upper compartment 9 (see FIG. 5 for example). A lower housing 15 fixedly mounted to a bottom of the bag includes a recharge plug 16 directed through a side wall of the lower housing 15, where the recharge plug 16 is operatively associated a chargeable battery 18 positioned within the enclosed chamber 17 of the lower housing 15. The recharge plug 16 permits recharging of the battery 18 when the organization is availed of convenient electrical power, in a manner well known in the use of rechargeable batteries. The bag 11 includes a shoulder strap 19 mounted longitudinally of the bag to an exterior surface thereof, with a hand strap 20. A lower hand warmer pouch 21 is mounted underlying the shoulder strap 19, with an upper hand pouch 22 positioned on an opposed side of the bag 11. Each lower and upper hand warmer pouch 21 and 22 respectively include a hand access zipper 23 directed through an end wall of each pouch, with a battery powered hand warmer 24 mounted within a lower compartment of each hand warmer pouch containing an associated hand warmer coil accessed through a zipper 121 for replacement and maintenance of each hand warmer coil 24. A respective web 21*a* and 22*a* are formed within each lower and upper hand warmer pouch 21 and 22 defining the upper and lower compartment of each hand warmer pouch. A storage pouch 25 is mounted to an exterior wall of the bag 11 underlying the upper hand warmer pouch 22, including a battery access zipper 26 providing access to a storage pouch lower compartment 28, with a storage pouch upper compartment 29 accessed through an upper storage pouch zipper 27. A divider wall 25*a* defines the upper storage pouch 27 relative to the lower storage pouch 28. Various components such as golf balls, towels, and the like are contained within the storage pouch upper compartment 29, with a respective battery powered hand warmer coil 24 provided within the lower storage pouch compartment 28.

A helically wound resistance heating coil 30 is mounted within a liner 31 positioned within the bag 11 within the golf club storage upper compartment 9. The coil 30 is in operative association with the rechargeable battery 18 for maintaining elevated temperature within the golf club storage upper compartment 9.

A modified bag 11*a* includes a gel filled container 32 mounted upon a floor 33 of the golf club storage upper compartment 9 to absorb heat and release such slowly from the associated coil 30 in use. Further, the gel filled container provides for a support for the various golf clubs directed through the aforenoted slits 14.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A heated golf bag apparatus comprising, in combination, an elongate longitudinally aligned bag, the bag including a lower compartment fixedly mounted to a lower end of the bag, with the lower compartment defining an enclosed lower chamber, the enclosed lower chamber including a rechargeable battery positioned therewithin, and a helically wound heating coil mounted coextensively within the bag above the lower compartment, with the heating coil in operative association with the battery.

2. An apparatus as set forth in claim 1 wherein the bag includes an elongate liner fixedly securing the heating coil within the bag.

3. An apparatus as set forth in claim 2 wherein the bag includes an upper bag band, the upper bag band mounting an elastomeric web orthogonally relative to the bag, and the elastomeric web including a matrix of slits therethrough, wherein the slits selectively receive a golf club therethrough in a sealing relationship to contain heat within the bag.

4. An apparatus as set forth in claim 3 wherein the battery includes a recharge plug directed through a side wall of the bag.

5. An apparatus as set forth in claim 4 wherein the bag includes a storage pouch fixedly mounted to an exterior wall of the bag, the storage pouch including a lower storage pouch container and an upper storage pouch container, with a storage pouch web orthogonally directed through the storage pouch to define the upper pouch container from the lower storage pouch container, and a first zipper directed through the upper storage pouch container to permit securement of golfing components therewithin, and the lower storage pouch container including a battery powered warming coil positioned therewithin, with a second zipper directed through the lower storage pouch container to provide access to the lower storage pouch container.

6. An apparatus as set forth in claim 5 wherein the bag includes an elongate shoulder strap mounted to a side wall of the bag and a hand strap mounted medially of the shoulder strap to the bag, and further including a lower hand warmer pouch and an upper hand warmer pouch, the lower hand warmer pouch and upper hand warmer pouch mounted fixedly to opposed sides of the bag, and each lower and upper hand warmer pouch including a respective hand access zipper directed through an end wall of each hand warmer pouch to provide access interiorly of each hand warmer pouch, and each hand warmer pouch including a lower hand warmer pouch compartment, and each hand warmer pouch compartment including a battery powered hand warmer coil therewithin.

7. An apparatus as set forth in claim 6 further including a gel filled container mounted fixedly and substantially coextensively of the bag above the lower compartment mounted to a floor of the bag defining a bag upper compartment.

* * * * *